US008998069B2

(12) United States Patent
Woodham et al.

(10) Patent No.: US 8,998,069 B2
(45) Date of Patent: Apr. 7, 2015

(54) PACKAGE WITH EASY ACCESS OPENING

(75) Inventors: L. Roseann Woodham, Easley, SC (US); Priyamvada Sohoni, Redwood City, CA (US)

(73) Assignee: Graphic Packaging International, Inc., Atlanta, GA (US)

( * ) Notice: Subject to any disclaimer, the term of this patent is extended or adjusted under 35 U.S.C. 154(b) by 441 days.

(21) Appl. No.: 12/868,835

(22) Filed: Aug. 26, 2010

(65) Prior Publication Data

US 2011/0049143 A1 Mar. 3, 2011

Related U.S. Application Data

(60) Provisional application No. 61/275,176, filed on Aug. 26, 2009.

(51) Int. Cl.

| | |
|---|---|
| ***B65D 6/00*** | (2006.01) |
| ***B31B 1/26*** | (2006.01) |
| ***B65D 5/36*** | (2006.01) |
| ***B65D 5/70*** | (2006.01) |

(52) U.S. Cl.

CPC ... *B65D 5/36* (2013.01); *B65D 5/70* (2013.01)

(58) Field of Classification Search

CPC ..... B65D 33/02; B65D 77/003; B65D 77/02; B65D 77/0406; B65D 5/566; B65D 2571/00839; B65D 5/0281; B65D 77/062; B65D 83/06; B65D 83/0805; B65B 67/1238; B65B 67/1205; B31B 2217/0046; B31B 2217/0076

USPC ..... 229/117.27, 164.2, 117.3; 220/255.1, 220/1.6; 493/907, 93, 95, 96, 217; 221/64

See application file for complete search history.

(56) References Cited

U.S. PATENT DOCUMENTS

| | | | | |
|---|---|---|---|---|
| 1,947,865 | A | | 2/1934 | Marsh |
| 2,000,210 | A | | 5/1935 | Bayless |
| 2,126,106 | A | | 8/1938 | Goldberg |
| 2,923,455 | A | | 2/1960 | Tingley |
| 2,984,401 | A | | 5/1961 | Herkender |
| 3,981,434 | A | * | 9/1976 | Ramich ..... 229/227 |
| 4,314,643 | A | | 2/1982 | Forbes, Jr. |
| 4,746,019 | A | * | 5/1988 | Prater ..... 229/207 |
| 4,768,703 | A | | 9/1988 | Sosler et al. |
| 4,773,542 | A | | 9/1988 | Schillinger et al. |
| 5,014,855 | A | | 5/1991 | Roccaforte |
| 5,027,748 | A | * | 7/1991 | Wolak ..... 119/168 |
| 5,028,147 | A | * | 7/1991 | Graham ..... 383/119 |

(Continued)

FOREIGN PATENT DOCUMENTS

| | | | |
|---|---|---|---|
| EP | 406556 | A1 | 1/1991 |
| JP | 11321848 | A | 11/1999 |

(Continued)

*Primary Examiner* — Christopher Demeree

(74) *Attorney, Agent, or Firm* — Womble Carlyle Sandridge & Rice, LLP

(57) ABSTRACT

The present package is formed from a bag construct that entirely surrounds a blank construct and that can be folded from a flat configuration to a carton configuration. The blank construct has five sides, including four sides and a bottom side, and an open top. The bag construct surrounds all four sides, the bottom, and the open top. The package includes a dispensing flap that provides access to contents, and the dispensing flap can be hinged about a hinge line or that can be removed entirely from the package. Any variance in density of product in the package can be accommodated by the stiff, yet flexible, sides of the package.

12 Claims, 6 Drawing Sheets

(56) References Cited

U.S. PATENT DOCUMENTS

| | | | |
|---|---|---|---|
| 5,096,114 | A | 3/1992 | Higginbotham |
| 5,193,740 | A | 3/1993 | Newborough et al. |
| 5,265,799 | A | 11/1993 | Stone |
| 5,314,114 | A | 5/1994 | Stone |
| 5,322,215 | A | 6/1994 | Roccaforte |
| 5,505,374 | A | 4/1996 | Stone |
| 5,511,722 | A | 4/1996 | Dixon |
| 5,673,849 | A | 10/1997 | Stone |
| 5,749,462 | A | 5/1998 | Houghton |
| 5,775,576 | A | 7/1998 | Stone |
| 5,788,102 | A | 8/1998 | Hall et al. |
| 5,873,516 | A | 2/1999 | Boggs |
| 5,924,626 | A | 7/1999 | Whitnell |
| 6,079,616 | A | 6/2000 | Chinks et al. |
| 6,196,448 | B1 | 3/2001 | Correll |
| 6,869,009 | B2 | 3/2005 | Sutherland et al. |
| 6,913,190 | B2 | 7/2005 | Ruhbusch et al. |
| 6,969,196 | B2 | 11/2005 | Woodham et al. |
| 6,979,482 | B2 | 12/2005 | Hartzell et al. |
| 7,090,904 | B2 | 8/2006 | Hartzell et al. |
| 7,544,403 | B2 | 6/2009 | Hartzell et al. |
| 7,549,269 | B2 | 6/2009 | Woodham et al. |
| 7,669,755 | B2 | 3/2010 | Smalley |
| 7,699,214 | B2 | 4/2010 | Mestre et al. |
| 7,703,665 | B2 | 4/2010 | McGowan |
| 2004/0091648 | A1 | 5/2004 | Hartzell et al. |
| 2004/0175060 | A1 | 9/2004 | Woodham et al. |
| 2004/0228547 | A1 | 11/2004 | Hartzell et al. |
| 2005/0006447 | A1 | 1/2005 | Caroli |
| 2006/0053746 | A1 | 3/2006 | Woodham et al. |
| 2006/0053752 | A1 | 3/2006 | Woodham et al. |
| 2006/0073292 | A1 | 4/2006 | Hartzell et al. |
| 2007/0119914 | A1* | 5/2007 | Mestre et al. ..... 229/117.34 |
| 2007/0235511 | A1 | 10/2007 | Fitzwater et al. |
| 2010/0002963 | A1* | 1/2010 | Holbert et al. ..... 383/204 |
| 2010/0019022 | A1* | 1/2010 | Ryan et al. ..... 229/122 |
| 2010/0108749 | A1 | 5/2010 | House |

FOREIGN PATENT DOCUMENTS

| | | | |
|---|---|---|---|
| JP | 2000-085755 | A | 3/2000 |
| JP | 2000-507531 | A | 6/2000 |
| JP | 2005088975 | A | 4/2005 |
| WO | WO-97/36792 | A1 | 10/1997 |

* cited by examiner

PACKAGE WITH EASY ACCESS OPENING

CROSS-REFERENCE TO RELATED APPLICATIONS

This application claims the benefit of U.S. Provisional Patent Application No. 61/275,176, filed Aug. 26, 2009.

INCORPORATION BY REFERENCE

U.S. Provisional Patent Application No. 61/275,176, filed Aug. 26, 2009, is hereby incorporated by reference for all purposes as if presented herein in its entirety.

BACKGROUND

This invention relates generally to packaging and, more particularly, to a packaging carton and a method for making a packaging assembly.

SUMMARY

In one aspect, the present invention generally provides a packaging or carton construction for holding and dispensing products.

In one aspect, the invention includes a package that comprises a first construct formed of a first material and a second construct formed of second material. The second construct is attached to a first portion of the first construct, and the second construct is foldable to define interior sides and a bottom of the package and the first construct is foldable to define a top, exterior sides, and an exterior surface of the bottom of the package. The first construct includes a dispensing flap defined by a first tear line and a second tear line in the top and by a third tear line and a fourth tear line in one side of the sides. The dispensing flap is separable along the first tear line, the second tear line, the third tear line, and the fourth tear line, and the dispensing flap can be hinged to allow the dispensing flap to be opened and reclosed. Optionally, a hinge line, along which the dispensing flap hinges, is disposed in the top. Optionally still, the hinge line is along and collinear with the fold line connecting the top and a second side of the package. Further, the dispensing flap can be removable from the package along the hinge line. Generally, the first construct entirely surrounds the second construct. Further still, the dispensing flap comprises a substantial entirety of the top.

In another aspect, the invention includes a method of forming a carton, with the method including: providing a blank construct and a bag construct, with the blank construct including a series of sides connected along fold lines to a bottom, with the blank construct being at least partially connected along a plurality of the series of sides to the bag construct, with at least one side of the blank construct not being connected to the bag construct, and with the bag construct surrounds the blank construct. The method further includes folding the blank construct and bag construct from a flat configuration to a carton configuration, and with the folding comprises positioning the plurality of sides of the blank construct substantially perpendicular the bottom side, with two of the sides being substantially parallel. The method further includes closing the carton by (1) folding the at least one side substantially perpendicular the bottom side, and then (2) folding the bag construct in a closed configuration. Optionally, the bag construct includes a dispensing flap defined by at least one tear line. Optionally still, the four sides of the blank construct, when folded in the carton configuration, define an open top, and the dispensing flap includes at least a section of one of the series of sides and at least a section of the open top. Further, the blank construct can be adhered to the bag construct.

In yet another aspect, the invention comprises a package that includes a blank construct attached to an interior of a bag construct, with the blank construct including a first blank side, a second blank side, a third blank side, and a fourth blank side, each connected along fold lines to a bottom blank side. The bag construct including a first bag side, a second bag side, a third bag side, and a fourth bag side, each connected along fold lines to a bottom bag side. The bottom blank side is connected to the first bag side and the first blank side being connected to the bottom bag side. The first blank side, the second blank side, the third blank side, and the fourth blank side are configurable in a carton configuration (1) to each be perpendicular to the bottom blank side and (2) to form an open top covered by the fourth bag side. Optionally, the blank construct and bag construct can be connected by an adhesive. Further, at least a portion of the second blank side and the third blank side can be connected to the second bag side and the third bag side. Further still, the bag construct can include a dispensing flap, with the dispensing flap being defined by at least one tear line that extends into the second bag side and into the fourth bag side or with the dispensing flap including the substantial entirety of the fourth bag side. Even further still, the dispensing flap can be hinged about a fold line, and, optionally, the dispensing flap can be entirely separable from the package.

Those skilled in the art will appreciate the above stated advantages and other advantages and benefits of various additional embodiments reading the following detailed description of the embodiments with reference to the below listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE INVENTION

The present disclosure generally relates to constructs, sleeves, cartons, or the like, for forming packages for holding and dispensing articles or product, such as food stuffs, dog food, etc.

Packages according to the present disclosure can accommodate product of numerous different shapes. For the purpose of illustration and not for the purpose of limiting the scope of the disclosure, the following detailed description describes pelletized foodstuffs at least partially disposed within the package embodiments. In this specification, the terms "lower," "bottom," "upper," and "top" indicate orientations determined in relation to fully erected packages.

Figure 1:
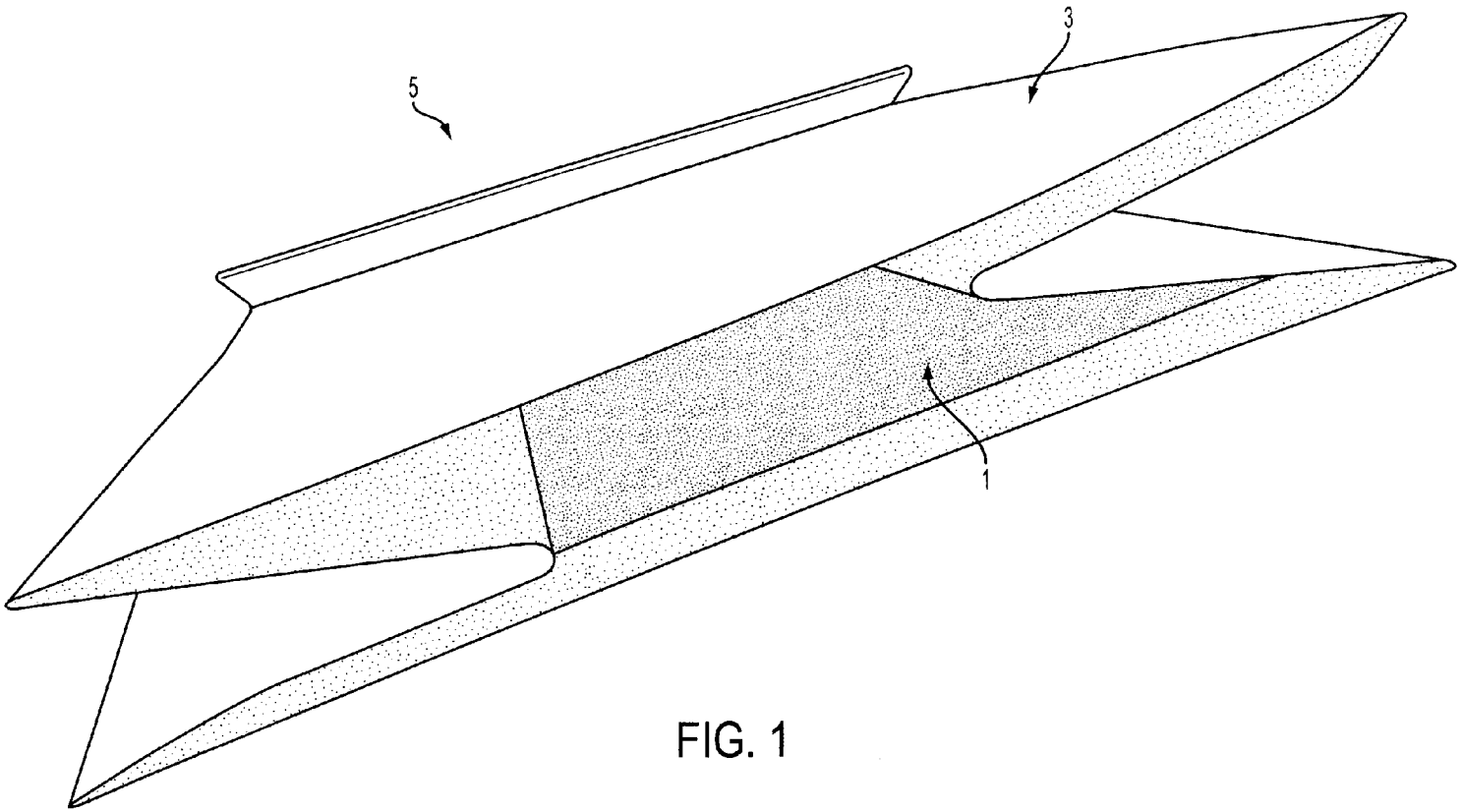
FIG. 1 shows a combination package construct in a flat configuration.

FIG. 1 shows of a blank construct 1 and a bag construct 3 disposed in a flat configuration 5. Generally, the blank construct 1 is connected to at least one inside surface of the bag construct 3 for form a combination package construct. The blank construct is connected to the bag construct either before the bag material is folded into a sleeve configuration, after the bag material is folded into a sleeve configuration, or after a first end of the bag material is formed. The blank construct can include, for example, four panels or sides connected along fold lines to a bottom panel or side. Other configurations or designs of the blank construct, i.e. with two to three or more than four side panels also can be provided for forming different shape or configuration packages. Generally at least the bottom panel of the blank construct is connected to a first interior bag surface, such as by an adhesive. The blank construct can be connected to the bag construct by any manner, such as by applying an adhesive, welding, heating, etc.

Figure 2:
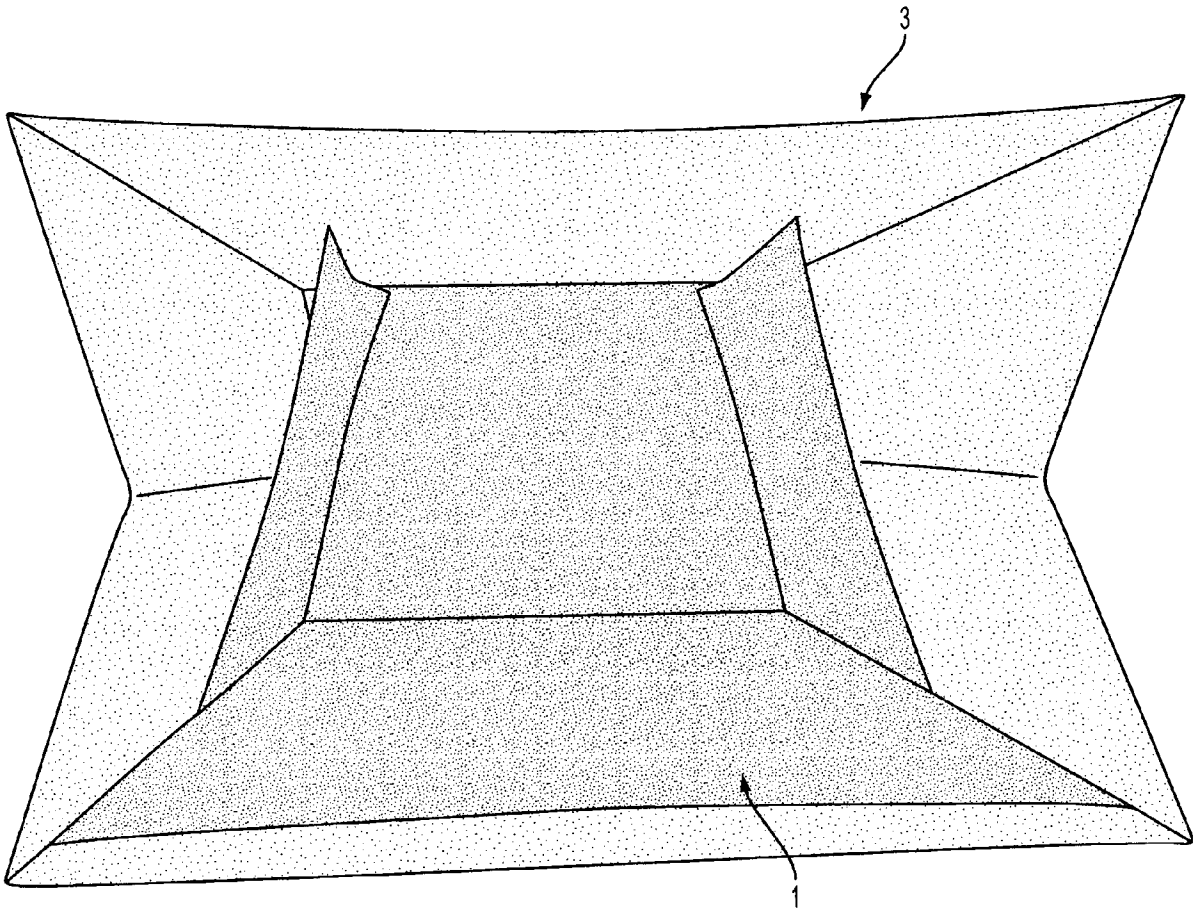
FIG. 2 shows the package construct of FIG. 1 in an open configuration.
Figure 3:
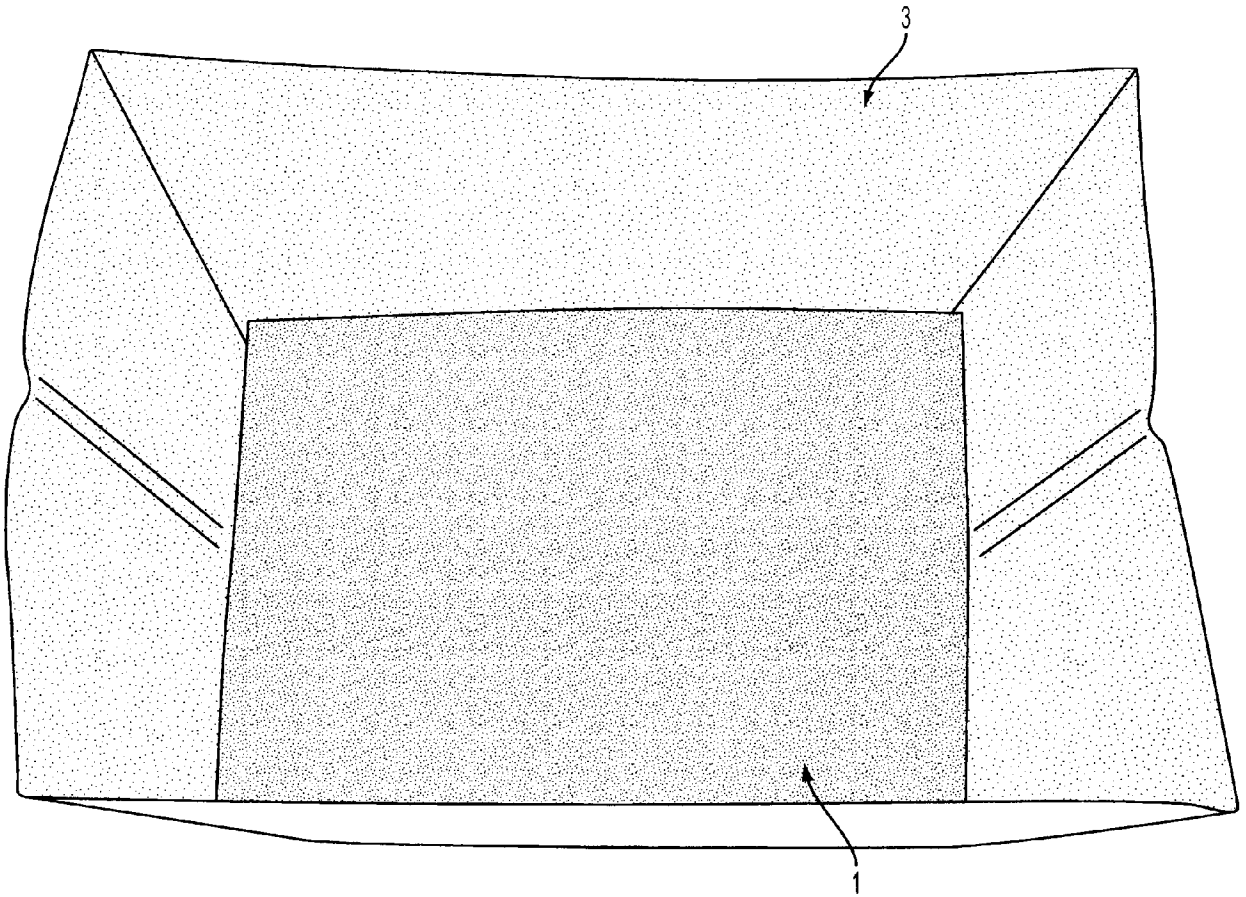
FIG. 3 shows the package construct of FIG. 2 with the blank construct completely formed into its carton configuration.

FIG. 2 shows the combination package construct being folded into an open configuration by folding or extending at least three sides of the blank construct 1 inside the bag construct 3 so that the sides are substantially perpendicular to the bottom side of the blank construct 1. As shown in FIG. 3, the method of forming the combination construct into a carton or package continues with the fourth side being folded upward to form an enclosed volume or defined space or chamber within the bag construct for receiving product(s) therein. The open end of the bag construct 3 then can be closed to form a product package or carton.

The bag construct 3 generally is formed from a first material and can, for example, be substantially liquid impermeable. The bag construct 3 generally includes at least one layer and can comprise multiple layers and parts of the first material or of other materials that enable the bag construct to function as detailed herein.

Figure 4:
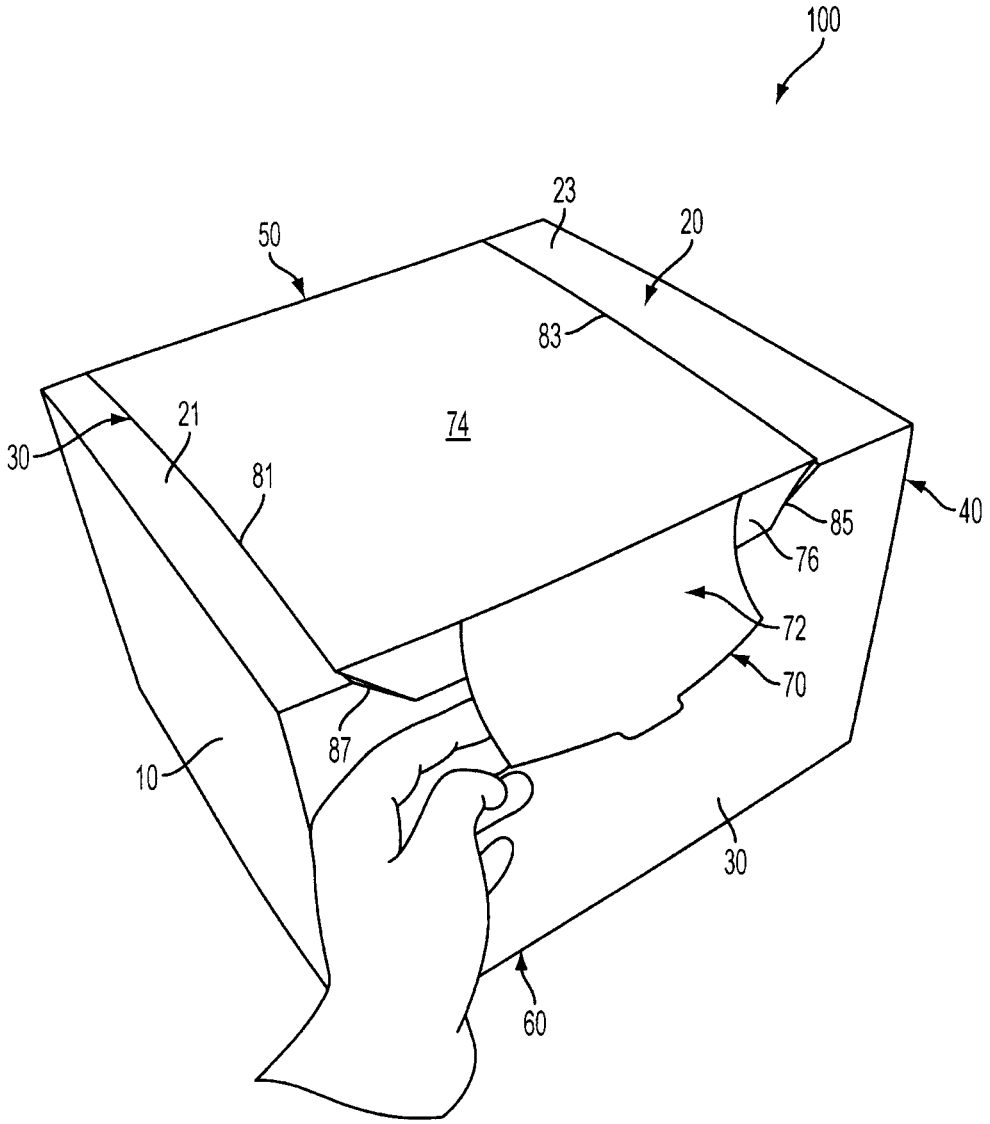
FIG. 4 shows a package according to a first embodiment of the invention.

As shown in FIG. 4, in one example embodiment, the enclosed carton or package 100 has six sides and generally comprises a rectangular prism, parallelepiped, or cube configuration. Although the orientation of the sides/panels/ends can be varied without being outside the scope of the present invention, the following arrangement is utilized for consistency throughout the several views. As shown in FIG. 4, a side 10 (which corresponds to the closed end of the bag construct 3 shown in FIG. 2) is shown as substantially parallel to an opposite side 40, and is connected to sides 30 and 50. A bottom side 60 (which corresponds to the bottom of the blank construct connected to one of the sides of the bag construct) is substantially perpendicular to sides 10, 30, 40, 50 and is connected along fold lines thereto. A top 20 is substantially parallel to and is arranged opposite bottom 60. The top 20 is substantially perpendicular to sides 10, 30, 40, 50 and is connected along fold lines thereto.

Figure 5:
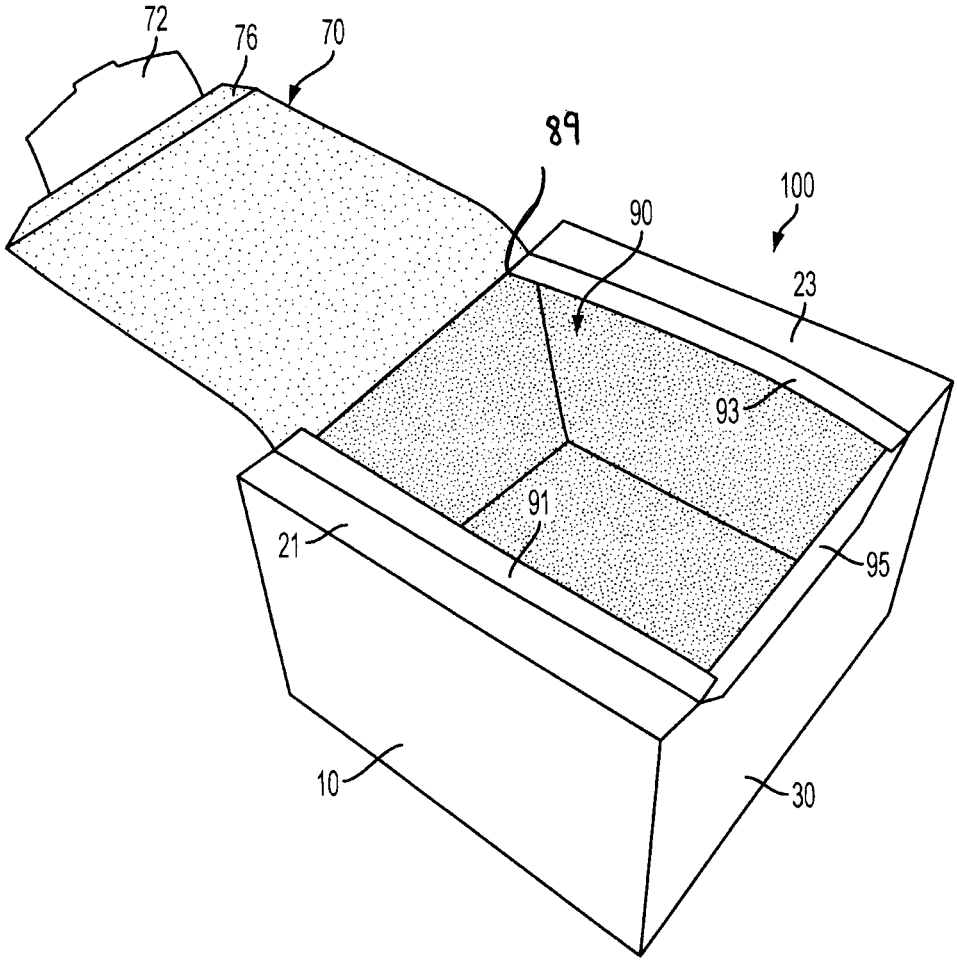
FIG. 5 shows the package of FIG. 4 with the dispensing flap open.
Figure 6:
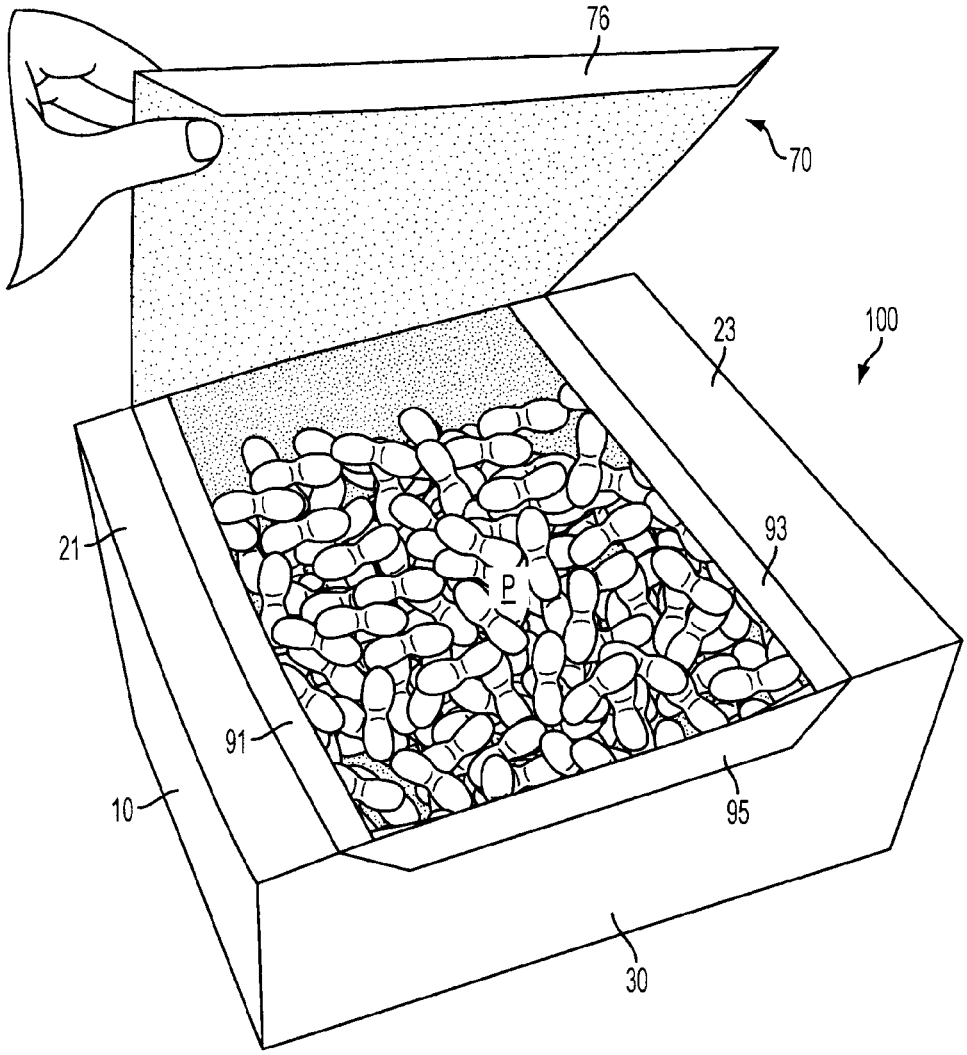
FIG. 6 shows the package of FIG. 5 filled partially with a food product.

As shown in FIGS. 4 through 6, a dispensing flap 70 is formed in the one side 30 (including an opening feature portion 72 connected to a first dispensing flap section as indicated at 76 in FIG. 4) and in the top 20 of the package 100 (with portion 74 of dispensing flap 70 disposed along the top 20). The dispensing flap 70 is separable from the carton or package along tear lines to form an opening 90 (FIG. 5). The top portion 74 of dispensing flap 70 in top 20 is defined by tear lines 81 and 83. The dispensing flap section 76 of dispensing flap 70 in side 30 is defined by tear lines 85 and 87 extending from the top 20 into side 30. The opening feature 72 is disposed along the dispensing flap section 76 and can be formed or defined as a finger flap or opening flap, and can be used to initiate detachment along the tear lines 85 and 87, then along tear lines 81, 83. As shown in FIG. 4, the top 20 can include remainder portions 21, 23, or, alternatively, the dispensing flap 70 can remove a substantial entirety of the top 20.

FIG. 5 shows the package 100 of FIG. 4 with the dispensing flap 70 being separated along tear lines 81, 83, 85, 87 in the top/side and hinged open along a hinge line to expose opening 90 in package 100. The dispensing flap 70 can be hinged about the hinge line to enable reclosing or resealing of the top 20. The hinge line 89 also could be formed as a tear line or with nicks, cuts, etc. to enable removal of the dispensing flap 70 as needed or desired. As shown in FIG. 5, the dispensing flap 70 is separated along tear lines 81 and 83 in top 20 to expose lips or edges 91 and 93 adjacent remainder portions 21 and 23, respectively. Further, the dispensing flap 70 exposes side portion 95 that is exposed when the dispensing flap 70 is separated along tear lines 85 and 87 in side 30. The lip(s) can be formed either of the same material used to form the carton, or can be formed of a liner material, such as plastic or coated paper material. Although not shown, locking features can be disposed on sections of the carton, such as at or adjacent portion 95, with the locking features capable of securing dispensing flap 70 in a closed position to close opening 90 with dispensing flap 70.

FIG. 6 shows package 100 filled, at least partially, with a food product P. As shown in FIG. 6, peanuts or other foodstuffs or other bulk or stacked products can be stored and dispensed from the package. The foodstuffs can be inserted into the package 100 during manufacture, such as by inserting the food stuffs when the combination construct is in the open configuration shown in FIG. 2. Alternatively, the foodstuffs can be individually packaged and poured or placed into the carton after the dispensing flap 70 is separated along the tear lines. For example, the foodstuffs can be packaged in a bag, or multiple bags inside the package 100, and then, after the dispensing flap 70 has been separated along the tear lines, the bag or bags can be opened and the foodstuffs can be poured by the consumer into the opening 90 of package 100 for ease of dispensing the products. Alternatively still, a manufacturer can package foodstuffs in bag(s) for sale on vendor shelves, and the present package 100 can used as a receiver for refills of foodstuffs.

The present package(s) are shown in an example embodiment as being generally cube-shaped to maximize advertising or product description space and palletizing efficiency. The dispensing flap can be hinged along or adjacent a fold line connecting the top with a side panel. The dispensing flap can be hinged closed and can be resealable to maintain freshness and prevent contamination of the product or foodstuffs within the package. Optionally, the dispensing flap can be separated along the hinge line to be removed entirely from the package.

The package(s) of the present invention generally is formed from a blank construct and a liner adhered to the blank construct. The liner will generally be applied and adhered to the blank at specific locations, such as at the remainder portions of the inner surface of the top panel/side. The liner can be a sealed bag formed inside the package, can be attached to the dispensing flap and separable along tear lines corresponding to the tear lines defining the dispensing flap in the top panel/side, and/or can be installed into the carton during manufacture in lieu of being adhered to the blank construct prior to being formed into a carton.

The present package can be formed with a semi-rigid top panel/side and a semi-rigid bottom panel/side, and generally will have sides formed of a stiff, but flexible material or in a stiff, but flexible configuration that allows the sides to be compressed. The flexibility of the sides allows, among other things, the product density to vary, allows the package to be compressed in cabinets yet easily transfer to conveyor belts, allows enough compression to adjust for differing product densities, and allows the product itself to bear the weight of the package on the pallet. The sides could, for example, be accordion shaped to allow compression or flexing, yet still provide stiffness and/or resiliency when/where needed. For example, if the present package contained pet food, which can vary in density (e.g. because of the season of the year (additional humidity) and/or the formulation of the food). Any variance in density of the product in the package could be accommodated by the stiff, yet flexible, sides of the package.

The open top configuration of the present package provides several advantages over prior packaging, including: providing a wide opening to ease scooping foodstuffs out of the package, with the hinging enabling the dispensing flap to remain open during scooping, allowing the top to be removed entirely to enable using the package as a feeding vessel, monitoring of the food level in the package as a reminder to replenish food timely, opening/closing the dispensing flap with one-hand, allowing the package to be used inside a home in lieu of traditional places products such as dog food or other, similar products are kept e.g. the garage, easy storage e.g. fitting easily into cabinet spaces, grease resistance in the inner and outer layer, and the use of the lip providing a leveling ledge for measuring accuracy.

The blanks constructs according to the present disclosure can be, for example, formed from coated paperboard and similar materials. For example, the interior and/or exterior sides of the blank constructs can be coated with a clay coating. The clay coating may then be printed over with product, advertising, price coding, and other information or images. The blank constructs may then be coated with a varnish to protect any information printed on the blank construct. The blank constructs may also be coated with, for example, a moisture barrier layer, on either or both sides of the blank construct. In accordance with the above-described embodiments, the blank constructs may be constructed of paperboard of a caliper such that it is heavier and more rigid than ordinary paper. The blank constructs can also be constructed of other materials, such as cardboard, hard paper, or any other material having properties suitable for enabling the carton to function at least generally as described herein. The blank constructs can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having the liner attached to the carton and/or one or more carton panels adhered together by glue during erection. The term "glue" is intended to encompass all manner of adhesives commonly used to secure carton panels in place.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package comprising:

a bag;

a blank disposed in an interior of the bag;

the blank being fixedly attached to a portion of the bag;

the blank being foldable to define interior sides and an interior bottom of the package and the bag being foldable to define an exterior top, exterior sides, and an exterior bottom of the package; and, a dispensing flap in the bag defined by a first tear line and a second tear line in the exterior top and by a third tear line and a fourth tear line in at least one side of the exterior sides;

wherein the dispensing flap is separable along the first tear line, the second tear line, the third tear line, and the fourth tear line; and wherein the dispensing flap can be hinged to allow the dispensing flap to be opened and reclosed.

2. The package of claim 1 wherein a hinge line is disposed in the exterior top.

3. The package of claim 2 wherein the hinge line is along and collinear with a fold line connecting the exterior top and a second exterior side of the bag.

4. The package of claim 2 wherein the dispensing flap is removable from the package along the hinge line.

5. The package of claim 1 wherein the bag entirely surrounds the blank.

6. The package of claim 1 wherein the dispensing flap comprises a substantial entirety of the exterior top.

7. The package of claim 1, wherein the blank comprises:

a plurality of panels comprising a bottom panel, a first side panel foldably connected to the bottom panel, a second side panel foldably connected to the bottom panel, a third side panel foldably connected to the bottom panel, and a fourth side panel foldably connected to the bottom panel; wherein the bottom panel is fixedly attached to the interior of the bag.

8. The package of claim 7, wherein the fourth side panel is arranged substantially perpendicular to the bottom panel, and wherein the fourth side panel is arranged substantially parallel to a sealed end of the bag.

9. The package of claim 1, wherein the interior sides and the interior bottom of the package define an interior open top, and wherein the dispensing flap covers at least a portion of the interior open top.

10. A method of forming a package, the method comprising:

providing a blank and a bag, the blank including a plurality of side panels connected along fold lines to a bottom panel, the blank at least partially connected along a plurality of the series of side panels to the bag, with at least one side panel of the blank free from connections to the bag, the bag being foldable to define an exterior top, exterior sides, and an exterior bottom of the package, wherein the bag surrounds the blank and the bag includes a dispensing flap defined by a first tear line and a second tear line in the exterior top and by a third tear line and a fourth tear line in at least one side of the exterior sides;

folding the blank and bag from a flat configuration to a package configuration, wherein the folding comprises positioning the plurality of side panels of the blank substantially perpendicular the bottom panel, with two of the side panels being substantially parallel; and, closing the package by (1) folding the at least one side panel substantially perpendicular the bottom panel, and then (2) folding the bag into a closed configuration.

11. The method of claim 10 wherein the side panels of the blank, when folded in the package configuration, define an open top, and wherein the dispensing flap covers at least a section of one of the series of side panels and at least a portion of the open top.

12. The method of claim 10 wherein at least a portion of the blank is fixedly attached to the bag.

* * * * *